US011304463B1

(12) United States Patent
Colangelo et al.

(10) Patent No.: US 11,304,463 B1
(45) Date of Patent: Apr. 19, 2022

(54) GLOVE WITH ATTACHABLE WEIGHTS

(71) Applicants: Lucia Colangelo, Niagara Falls (CA); Diana Colangelo, Niagara Falls (CA); Donato Colangelo, Niagara Falls (CA)

(72) Inventors: Lucia Colangelo, Niagara Falls (CA); Diana Colangelo, Niagara Falls (CA); Donato Colangelo, Niagara Falls (CA)

( * ) Notice: Subject to any disclaimer, the term of this patent is extended or adjusted under 35 U.S.C. 154(b) by 0 days.

(21) Appl. No.: 15/971,451

(22) Filed: May 4, 2018

Related U.S. Application Data

(60) Provisional application No. 62/597,743, filed on Dec. 12, 2017.

(51) Int. Cl.

| | |
|---|---|
| ***A63B 21/06*** | (2006.01) |
| ***A41D 19/00*** | (2006.01) |
| ***A61H 1/02*** | (2006.01) |
| ***A63B 21/065*** | (2006.01) |
| ***A63B 21/00*** | (2006.01) |

(52) U.S. Cl.
CPC ..... *A41D 19/0024* (2013.01); *A61H 1/0285* (2013.01); *A63B 21/065* (2013.01); *A63B 21/4019* (2015.10); *A41D 2600/00* (2013.01); *A61H 2201/1635* (2013.01); *A61H 2205/065* (2013.01)

(58) Field of Classification Search
CPC ..... A41D 19/0024; A63B 21/4019; A63B 21/065; A61H 1/0285
See application file for complete search history.

(56) References Cited

U.S. PATENT DOCUMENTS 1,670,176 A * 5/1928 Woolery ..... G08B 5/02 116/35 R
3,149,839 A * 9/1964 Materia ..... A63D 5/00 473/59
D200,415 S * 2/1965 Tarbox ..... D21/683
3,189,073 A * 6/1965 Todd ..... A45C 1/04 224/222
3,490,766 A * 1/1970 Gardner ..... A63B 21/065 482/105
3,731,927 A * 5/1973 Rocco, Jr. ..... A63B 67/10 473/424
3,751,031 A * 8/1973 Yamauchi ..... A63B 21/4009 482/105
3,843,126 A * 10/1974 Bandy ..... A63B 67/10 473/576
4,034,979 A * 7/1977 Wester ..... A63D 5/00 473/59
4,247,097 A * 1/1981 Schwartz ..... A63B 21/065 482/105
4,253,660 A * 3/1981 Tiktin ..... A63B 21/065 2/160
4,330,120 A * 5/1982 Netti ..... A63B 21/065 2/160
4,368,883 A * 1/1983 Tiktin ..... A63B 21/065 2/162
4,414,692 A * 11/1983 Dzierson ..... A41D 19/0024 2/160

(Continued)

*Primary Examiner* — Richale L Quinn
(74) *Attorney, Agent, or Firm* — Cramer Patent & Design, PLLC; Aaron R. Cramer

(57) ABSTRACT

A glove lacking finger tips having a first weighted bag secured to the top side of the glove and a second weighted bag is removably secured to the underside of the glove within the palm.

2 Claims, 4 Drawing Sheets

(56) References Cited

U.S. PATENT DOCUMENTS 4,575,075 A * 3/1986 Tarbox ..... A63B 21/065 2/161.1
4,670,909 A * 6/1987 Forrester ..... A41D 19/002 2/160
4,684,123 A * 8/1987 Fabry ..... A63B 21/065 482/105
4,700,405 A * 10/1987 Sternberg ..... A63B 71/146 2/161.1
4,791,682 A * 12/1988 Herr ..... A41D 19/01 2/159
4,796,306 A * 1/1989 Mitchell ..... A63B 71/148 2/161.5
4,836,554 A * 6/1989 Robbins ..... A63B 67/20 273/DIG. 30
4,846,464 A * 7/1989 Jorno ..... A63B 21/065 482/105
4,862,521 A * 9/1989 Mann ..... A41D 19/002 2/160
4,911,433 A * 3/1990 Walker ..... A63B 21/065 2/161.1
4,923,418 A * 5/1990 Hoffman ..... A63B 21/065 441/57
5,187,814 A * 2/1993 Gold ..... A41B 11/00 2/160
5,214,799 A * 6/1993 Fabry ..... A41D 19/01523 2/161.6
5,386,591 A * 2/1995 Canan ..... A63B 71/141 2/160
D380,874 S * 7/1997 Caswell ..... D2/617
5,694,261 A * 12/1997 Deal ..... G02B 7/002 359/879
5,704,066 A * 1/1998 Yamamoto ..... A41D 19/015 2/160
5,768,710 A * 6/1998 Williams ..... A63B 21/065 2/160
5,779,603 A * 7/1998 Nusbaum ..... A63B 21/065 482/105
5,802,615 A * 9/1998 Wenk ..... A63B 71/146 2/160
5,820,526 A * 10/1998 Hoffman ..... A63B 21/065 482/55
D410,956 S * 6/1999 Adams Zurawin ..... D29/113
6,368,241 B1 * 4/2002 Abel ..... A63B 69/0086 473/508
6,553,574 B1 * 4/2003 Hall, Jr. ..... A63B 21/065 2/160
6,918,842 B2 * 7/2005 Miller ..... A63B 69/0002 473/422
6,990,689 B1 * 1/2006 Thellmann ..... A63B 21/065 2/161.1
7,364,518 B2 * 4/2008 Abel ..... A63B 43/007 473/508
7,563,183 B2 * 7/2009 Kucek ..... A63B 69/0002 473/422
7,856,670 B1 * 12/2010 Hazuga ..... A63B 23/16 2/160
7,908,672 B2 * 3/2011 Butler ..... A63B 71/141 2/162
8,312,567 B1 * 11/2012 Valle ..... A63B 21/0603 2/161.1
8,876,667 B2 * 11/2014 Russotti ..... A63B 21/4021 482/44
8,966,666 B2 * 3/2015 Faulconer ..... A63B 71/141 2/161.1
9,387,111 B2 * 7/2016 Klutts ..... A61F 5/0118
10,252,105 B2 * 4/2019 Dickens ..... A63B 21/151
2018/0255848 A1 * 9/2018 Moreau ..... A41D 19/002

* cited by examiner

GLOVE WITH ATTACHABLE WEIGHTS

RELATED APPLICATIONS

The present invention was first described in and claims the benefit of U.S. Provisional Application No. 62/597,743 filed Dec. 12, 2017, the entire disclosures of which are incorporated herein by reference.

FIELD OF THE INVENTION

The present invention relates generally to a glove with at least one (1) weighted back secured thereon.

BACKGROUND OF THE INVENTION

One (1) of the most common types of physical therapy is hand and arm rehabilitation. Whether such rehabilitation is necessary because of injury, disease, or surgery, much time and effort is spent by patients and therapists alike simply regaining control and function of one's arms and hands, while eliminating or at least reducing residual pain. While there is a large variety of exercises and physical devices to aid in such endeavors, many of these approaches utilize the use of weights to strengthen muscles and stretch ligaments to help restore mobility and dexterity. As one can imagine, these weights must be held in one's hands, and either moved about, or allowed to hang at one's side in an effort to stretch body elements, to be effective. However, such holding action becomes quickly tiring, restricts other activities in which other objects must be held, and may even be impossible to do should the hand or arm be severely impaired. Accordingly, there exists a need for a means by which various weights can be applied to the hand area for purposes of physical rehabilitation without the necessity to physically hold said weights. The development of the glove with attachable weights fulfills this need.

SUMMARY OF THE INVENTION

The principles of the present invention provide such a glove that includes a glove body having a palmate side, a distal side, and a wrist opening, a plurality of glove fingers, each protruding away from the glove body opposite the wrist opening, each glove finger having an open distal end, and a securing strap located adjacent the wrist opening. A first bag is attached to the glove body distal side. A second bag is removably attached to the glove body palmate side. A clip is attached to a location on one (1) of the plurality of fingers with a tether. The securing strap is capable of securing the glove to a wrist. Also, weighted material is disposed within the first bag and the second bag.

It is therefore an object of the present invention to provide such glove fingers that are configured to enable said open distal ends to terminate after the major knuckles. Other embodiments provide for glove fingers that are configured to enable said open distal ends to terminate after the minor knuckles.

It is a further object of the present invention to provide such a first bag to be attached to the glove body distal side adjacent the securing strap with a first bag first attachment point and along a side of an index glove finger with a first bag second attachment point. In at least one (1) embodiment, an interior of said first bag includes a liner.

It is another object of the present invention to provide such a second bag to be removably attached to the glove body palmate side adjacent the wrist opening with a second bag first attachment point and removably attached to an index glove finger with a second bag second attachment point. In at least one (1) embodiment, an interior of the second bag includes a liner. In other embodiments, the second bag is generally "L"-shaped.

It is yet another object of the present invention to provide an attachment strap affixed to the second bag and capable of being routed through the clip.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
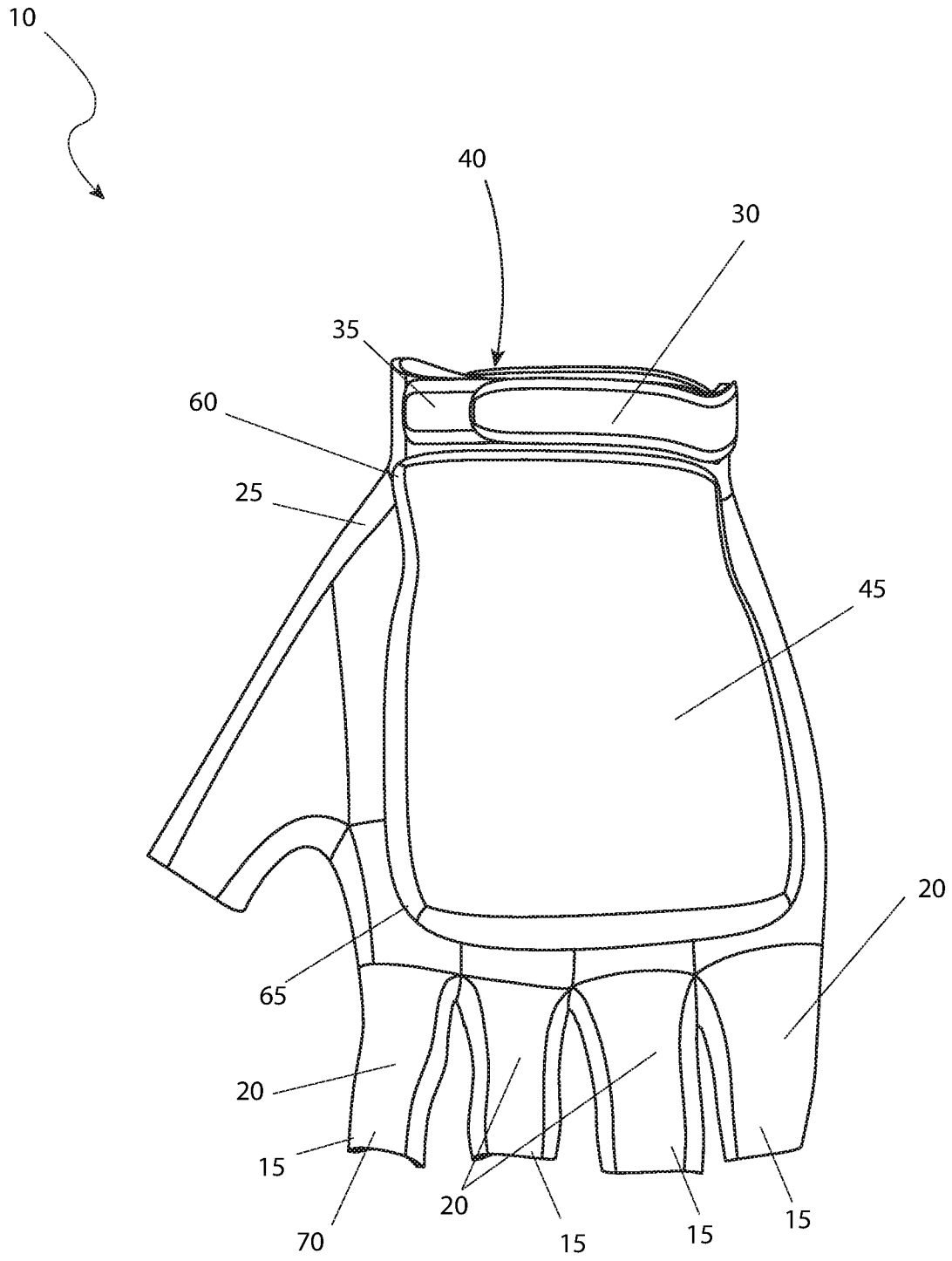
FIG. 1 is a rear view of the glove 10, according to the preferred embodiment of the present invention.

10 glove
15 glove finger
20 knuckle
25 glove wrist
30 securing strap
35 first hook-and-loop fastening means
40 hand opening
45 back of hand weight bag
50 weight material
55 interior plastic liner
60 back of hand bag first attachment point
65 back of hand bag second attachment point
70 glove index finger
75 palm of hand weight bag
80 palm of hand bag first attachment point
85 second hook-and-loop attachment means
90 palm of hand bag second attachment point
95 clip
100 attachment strap
105 third hook-and-loop fastening means
110 user
115 downward force "d"
120 lifting force "t"
125 hand
130 wrist
135 forearm
140 elbow
145 upper arm
150 shoulder
155 fore and aft movement "fa"
160 right and left movement "rl"

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

Referring now to FIG. 1, a rear view of the glove 10, according to the preferred embodiment of the present invention is disclosed. The glove with 10, (herein described as the "apparatus") 10, has the initial appearance and overall functionality of a fingerless glove, commonly used in various sports. It is envisioned that the apparatus 10 would be made available in multiple colors and styles, thus the depiction of one (1) design (as shown in the figures) is not intended to be a limiting factor of the present information. Likewise, it is envisioned that the apparatus 10 would be made available in multiple sizes (such as small, medium, large, extra-large, and the like) to fit all sizes of users from male to female and child to adult.

The glove fingers 15 covers the area just beyond the knuckles 20 area and terminates at the glove wrist 25 area. The knuckles area 20 is generally thought to the major knuckles 20 (e.g., the knuckles 20 closest to the tips of the fingers). Other embodiments provide for the glove fingers 15 to terminate near the minor knuckles 20 (e.g. the second knuckles 20 from the tip of the finger). The glove 10 is secured in place about the glove wrist 25 via a securing strap 30 provided with a first hook-and-loop fastening means 35 such as VELCRO®. This securement provides the ability of the apparatus 10 to adjust to different sized hands and thus different sized users as well as secure the apparatus 10 to the user preventing accidental dislodgement during use or movement. Additionally, when the securing strap 30 is not engaged, it provides a large hand opening 40 for the purposes of inserting one's hand, perhaps injured, into the apparatus 10 without being overly restrictive or generating pain.

It is envisioned that the fabric material comprising the majority of the apparatus 10 would be made of elastic materials such as nylon, neoprene or the like. Other surfaces, especially those subject to wear, are envisioned to be made of more durable textiles such as canvas, denim, suede, or the like. However, a wide variety of textile materials are suitable for intended use with the apparatus 10 and as such, the use of any particular textile or combination of textiles, should be interpreted as a limiting factor of the present invention.

This figure also discloses a back of hand weight bag 45, made of the same exterior material as used on the body of the apparatus 10. The interior of the back of hand weight bag 45 is filled with a weight material 50 (not shown due to illustrative limitations). The weight material 50 would be a dense material including but not limited to: lead, steel, steel shot, lead shot, sand, various grains, beans, small stones, or the like. The interior of the back of hand weight bag 45 may be provided with an interior plastic liner 55 (not shown due to illustrative limitations) to prevent leakage, especially with small dimension material such as sand. The overall weight of the weight material 50 would vary by physical size of the apparatus 10, as well as needs of the physical therapy requirements itself. However, an approximate average weight would be approximately two pounds (2 lbs.). The back of hand weight bag 45 is physically attached to the body of the apparatus 10 at two (2) locations. The back of hand bag first attachment point 60 is located along the top wrist area (located underneath the securing strap 30). The back of hand bag second attachment point 65 is along the side of the glove index finger 70. Both the back of hand bag second attachment point 65 and glove index finger 70 are envisioned to be of a permanent nature such as afforded by thread stitching. The presence of only two (2) attachment points allows for movement and subsequent flexing of the back of hand weight bag 45 with relation to the body of the apparatus 10 permitting flexing of the hand as necessary for movement, grasping, and the like.

Figure 2:
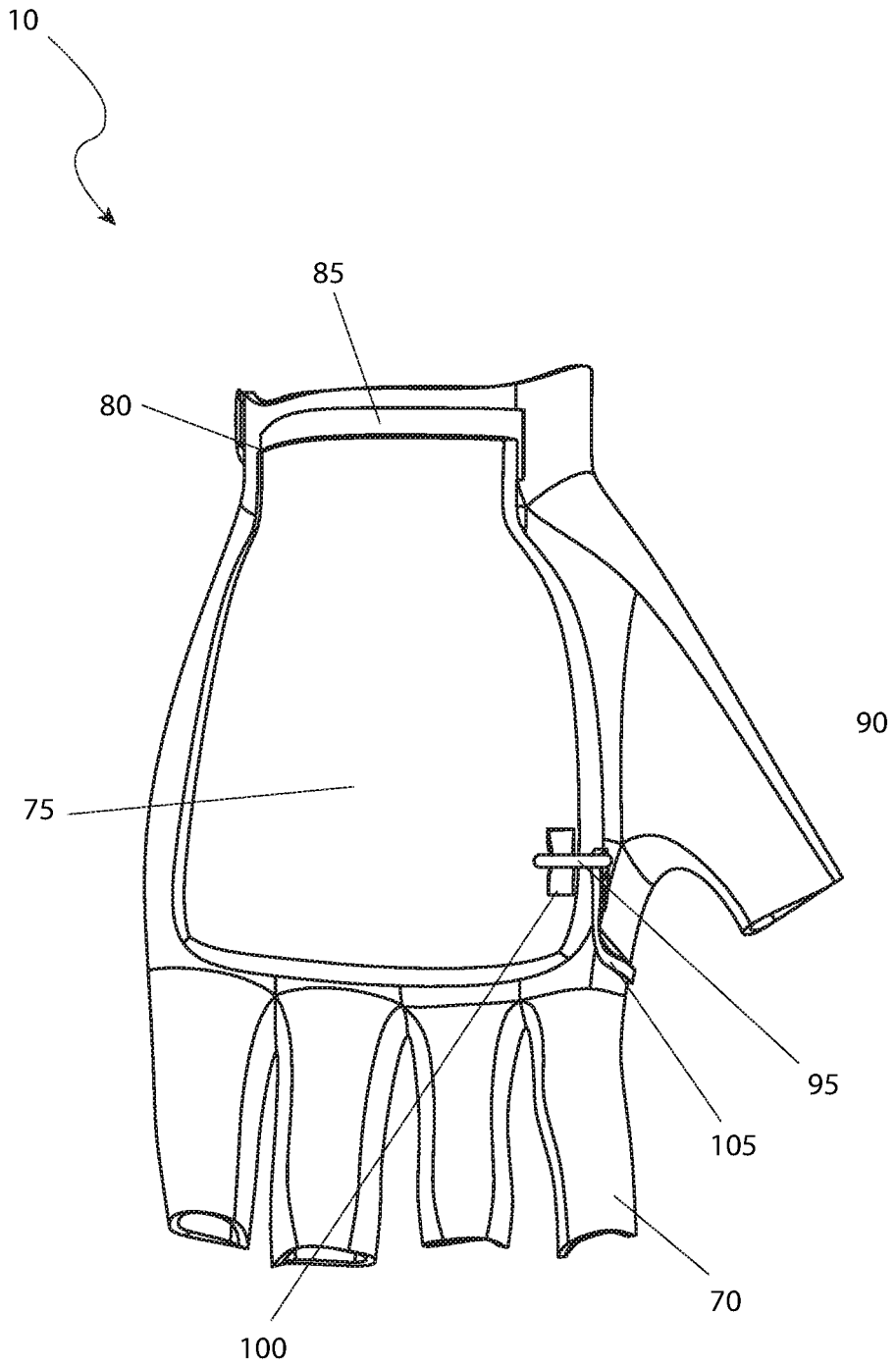
FIG. 2 is a front view of the glove 10, according to the preferred embodiment of the present invention.

Referring next to FIG. 2, a front view of the apparatus 10, according to the preferred embodiment of the present invention is depicted. The front view of the apparatus 10 exposes a view normally viewed as a palm area of a glove. The palm area provides for placement of a palm of hand weight bag 75 provided in a generally "L"-shaped configuration as shown. The "L" shape allows for conformance to the natural shape of one's hands. As is the case with the back of hand weight bag 45 (as shown in FIG. 1), the palm of hand weight bag 75 is provided with internal weight material 50 (not shown due to illustrative limitation) which may include an interior plastic liner 55 (not shown due to illustrative limitations). However, the palm of hand weight bag 75 is only temporarily attached to the apparatus 10. This feature allows the palm of hand weight bag 75 to be removed while the remainder of the apparatus 10 (glove assembly as well permanently attached back of hand weight bag 45) remains in place to serve therapeutic functions. The resultant open palm area then allows the wearer to perform grasping operations, such as necessary to use other exercise equipment or accessibility aids, perform writing or typing operations, grooming, eating, or virtually any activity that requires openness or access to the hand's palm area. The palm of hand weight bag 75 is attached via a palm of hand bag first attachment point 80 just below the wrist area via a second hook-and-loop attachment means 85 such as VELCRO®. Additionally, the palm of hand weight bag 75 is attached via a palm of hand bag second attachment point 90 to the glove index finger 70. A clip 95 is attached to the glove index finger 70 via sewing. An attachment strap 100, permanently attached to the palm of hand weight bag 75 is routed through the clip 95 and secured via folding the attachment strap 100 back upon itself and secured with a third hook-and-loop fastening means 105.

Figure 3:
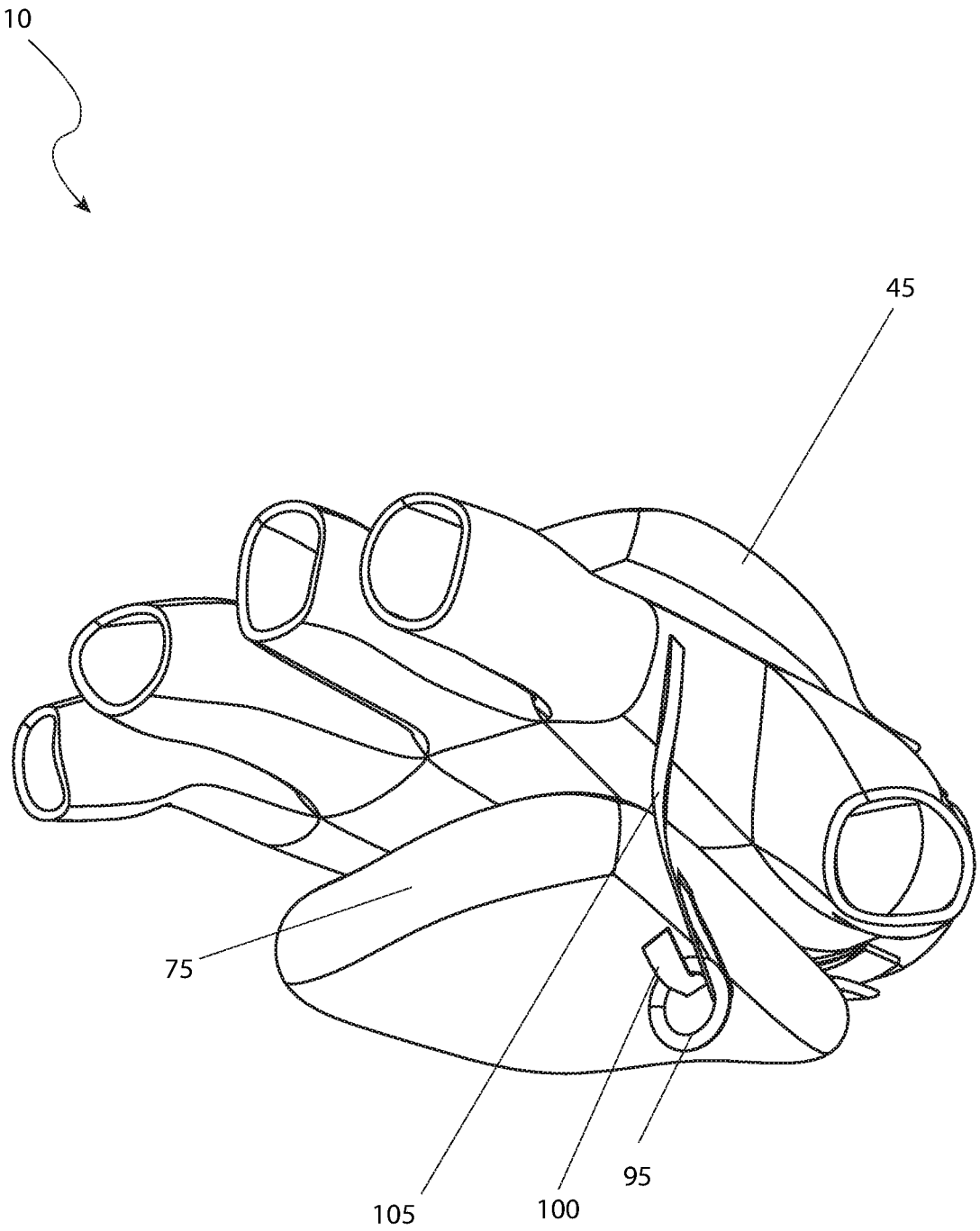
FIG. 3 is a side view of the glove 10, according to the preferred embodiment of the present invention; and, FIG. 4 is a perspective view of the glove 10 shown in a utilized state, according to the preferred embodiment of the present invention.

Referring now to FIG. 3, a side view of the apparatus 10, according to the preferred embodiment of the present invention is shown. This figure provides clear visualization of both the back of hand weight bag 45 and palm of hand weight bag 75 on the back and palm side of the apparatus 10 respectively. These locations provide a balanced structure when wearing and utilizing the apparatus 10 while allowing for user adjustment by removal and/or placement of the palm of hand weight bag 75 depending on ancillary tasks being performed during daily life versus the need for rehabilitation exercise and necessary weight application. This figure also provides additional insight on the placement and usage of the clip 95, the attachment strap 100, and the third hook-and-loop fastening means 105. It is envisioned that the apparatus 10 may be applied and removed with the palm of hand weight bag 75 already in place.

Figure 4:
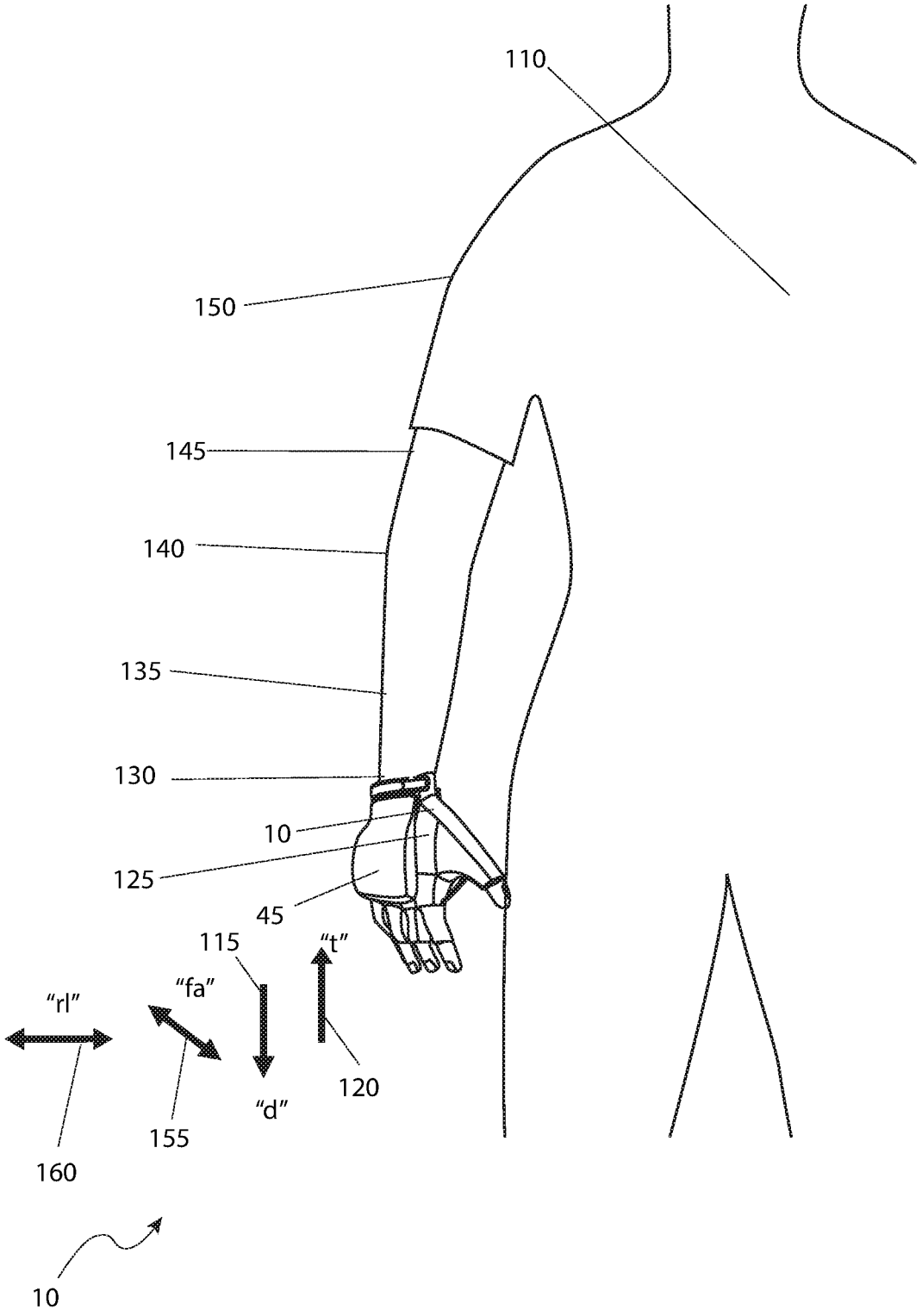

Referring finally to FIG. 4, a perspective view of the apparatus 10 shown in a utilized state, according to the preferred embodiment of the present invention is disclosed. The apparatus 10 is shown on the right hand/arm of a user 110. It should be noted that the apparatus 10 would be made available in both right- and left-handed versions to allow for use on either or both hands/arms of user 110 depending on specific needs. The apparatus 10 in conjunction with the back of hand weight bag 45 and palm of hand weight bag 75 serves to exert downward force "d" 115. The downward force "d" 115 provides stretching of the muscles, bones, and ligaments in the hand 125, the wrist 130, the forearm 135, the elbow 140, the upper arm 145 and the shoulder 150 along with pressure to aid in healing, pain relief, and overall recovery. The user 110 may also perform fore and aft movement "fa" 155, right and left movement "rl" 160, or any combination thereof during rehabilitation activities.

The preferred embodiment of the present invention can be utilized by the common user in a simple and effortless manner with little or no training. It is envisioned that the apparatus 10 would be constructed in general accordance with FIG. 1 through FIG. 3 and provided the benefits as disclosed in FIG. 4.

During procurement of the apparatus 10, the user 110 would preselect either right- or left-hand utilization, size (small, medium, large, extra-large), and weight application (envisioned to be one-quarter to two pounds (0.25-2.0 lbs.)). At this point in time, the apparatus 10 is then ready for immediate utilization.

To utilize the apparatus 10, the user 110 would apply it to either the right or left hand 125 as needed in a normal manner. The securing strap 30 would then be secured using the first hook-and-loop fastening means 35. The user 110 would then decide to apply the palm of hand weight bag 75 or not. An affirmative decision would be based upon specific rehabilitation needs requiring the extra weight and/or balance provided by the palm of hand weight bag 75. A negative decision would be based upon the need to utilize the grasping power of the hand 125 (necessitating access to the palm area) or simply based upon the decision that the extra weight and/or balance is not needed or desired.

If the application of the palm of hand weight bag 75 is needed, the user 110 would secure it to the palm area using the palm of hand bag first attachment point 80 including the use of the second hook-and-loop attachment means 85. The palm of hand bag second attachment point 90 would then be secured using the clip 95, the attachment strap 100, and the third hook-and-loop fastening means 105.

At this point in time, the user 110 would proceed with daily everyday tasks while taking comfort in the pressure and weight applied by the apparatus 10 resulting in an associated downward force "d" 115. Additionally, it is envisioned that the downward force "d" 115 would provide slight separation of the joints of the wrist 130, the elbow 140 and the shoulder 150 resulting in pain relief and associated healing over time. Specific exercises designed to rehabilitate and strengthen muscles, bones and ligaments in the hand 125, the wrist 130, the forearm 135, the elbow 140, the upper arm 145 and/or the shoulder 150 would be performed as directed by a physical therapist or self-directed exercise regimen.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A glove, consisting of:

a glove body having a palmate side, a distal side, and a wrist opening;

a plurality of glove fingers each protruding away from said glove body opposite said wrist opening, each said glove finger having an open distal end;

a securing strap located adjacent said wrist opening;

a first bag attached to said glove body distal side;

a second bag removably attached to said glove body palmate side; and a clip attached to a location on one of said plurality of fingers with a tether;

wherein said securing strap is securing said glove to a person's wrist;

wherein a weighted material is disposed within said first bag and said second bag;

wherein the glove fingers enable said open distal ends to terminate after a plurality of minor knuckles;

wherein an attachment strap is affixed to said second bag and is routed through said clip; and wherein the glove is secured in place about a glove wrist via the securing strap provided with a first hook-and-loop fastener.

2. A glove, consisting of:

a glove body having a palmate side, a distal side, and a wrist opening;

a plurality of glove fingers each protruding away from said glove body opposite said wrist opening, each said glove finger having an open distal end;

a securing strap located adjacent said wrist opening;

a first bag attached to said glove body distal side;

a L shaped second bag removably attached to said glove body palmate side; and a clip attached to a location on one of said glove fingers with a tether;

wherein said securing strap is securing said glove to a person's wrist;

wherein a weighted material is disposed within said first bag and said second bag;

wherein the glove fingers enable said open distal ends to terminate after a plurality of minor knuckles;

wherein an attachment strap is affixed to said second bag and is routed through said clip; and wherein the glove is secured in place about a glove wrist via the securing strap provided with a first hook-and-loop fastener.

* * * * *